United States Patent [19]

Okuno

[11] Patent Number: 4,921,385

[45] Date of Patent: May 1, 1990

[54] TRUCK WITH A HAND-OPERATABLE BED

[75] Inventor: Isamu Okuno, Osaka, Japan

[73] Assignee: Kabushiki Kaisha Okudaya Giken, Osaka, Japan

[21] Appl. No.: 230,952

[22] Filed: Aug. 11, 1988

[30] Foreign Application Priority Data

Mar. 29, 1988 [JP] Japan ..... 63-42279[U]

[51] Int. Cl.[5] ..... B66F 9/06

[52] U.S. Cl. ..... 414/21; 212/150; 187/9 R; 187/110; 187/131; 254/2 R; 254/93 R; 414/495

[58] Field of Search ..... 414/21, 495, 496, 497, 414/592, 629, 631–636, 641, 642, 673; 187/9 R, 9 E, 131, 110; 254/2 R, 2 B, 2 C, 93 R

[56] References Cited

U.S. PATENT DOCUMENTS

| | | | |
|---|---|---|---|
| 2,851,171 | 9/1958 | Martin et al. | 414/21 |
| 3,866,200 | 2/1975 | Paredes et al. | 414/21 X |
| 4,455,115 | 6/1984 | Alger et al. | 414/21 |
| 4,497,501 | 2/1985 | Kedam . | |

FOREIGN PATENT DOCUMENTS

| | | | |
|---|---|---|---|
| 2401407 | 4/1979 | France | 212/150 |
| 8956 | 1/1980 | Japan | 414/21 |
| 6138844 | 5/1980 | Japan . | |
| 61-46400 | 10/1986 | Japan . | |

*Primary Examiner*—Frank E. Werner
*Attorney, Agent, or Firm*—Harold Gell

[57] ABSTRACT

This invention relates to a truck with a hand-operatable bed provided with wheels for use in moving, a hydraulic cylinder for lifting or lowering the bed, and a plunger pump for feeding oil into the hydraulic cylinder by pulling a pumping handle, which is characterized by being additionally provided with a load sensor that detects the change in the hydraulic pressure inside the cylinder, and an indicator that indicates that change calculated in terms of the weight of a cargo on the bed. The truck is also characterized in that an arm whose top is provided with a foot pedal, and a pumping handle receiver which receives a pumping handle, both the foot pedal and the pumping handle being used to pump oil in the cylinder, are separately supported by their own pivot, and the pivot of the pumping handle receiver is located in such a position between the pivot of the arm and a shaft of a pressing roller that presses down the arm in company with the pulling-down of the pumping handle as to differentiate the ascending pitch of the bed by one stroke of the pumping handle from that by one stroke of the foot pedal.

2 Claims, 16 Drawing Sheets

TRUCK WITH A HAND-OPERATABLE BED

FIELD OF THE INVENTION

This invention concerns a truck with a hand-operatable bed. More particularly, it concerns a truck provided with a forked bed or pallet that can be lifted or lowered between a pair of vertically juxtaposed masts at operators' disposal when cargoes are required to put on or take out from a height.

PRIOR ART

So far there has certainly been used a truck with such kind of bed or pallet that can be moved upward or downward by means of a hydraulic cylinder coupled with a hand-operatable plunger pump. However, cargoes are warehoused by or loaded on the truck without previously confirming their weight, so that there used to be a danger of their pile collapsing due to the imbalance of their weight. For all that, providing the bed with a balance to weigh them with is not so simple as expected that there have always been problems in their handling.

SUMMARY OF THE INVENTION

Under the circumstances, the present inventor made intensive studies to eliminate drawbacks of a conventional truck and finally accomplished this invention by providing it with a load sensor that detects the change in the hydraulic pressure inside a cylinder, and an indicator that indicates that change calculated in terms of the weight of a cargoes on a bed. Thus, a cargo can be lifted up to a height for keeping in a warehouse or for loading on an automobile truck with its weight being confirmed with no use of a special balance. On account of that, not only is the collapsing of piled cargoes due to the imbalance of their weight in piling prevented previously, but also operators can promptly handle them, knowing what cargoes are overweight for loading with the result that the practical value of the truck is increased, as well as the operators' safety is improved.

Moreover, in the truck of this invention, an arm whose top is provided with a foot pedal and a pumping handle both of which are used to pump oil into a cylinder from an oil tank are separately supported by their own pivot, and the pivot of a pumping handle receiver is located in such a position, relative to the pivot of the arm and a shaft of a pressing roller that presses down the arm in company with the pulling down of the pumping handle, as to differentiate the ascending pitch of the bed by one stroke of the pumping handle from that by one stroke of the foot pedal. Therefore, the bed can be elevated slowly or fast at operators' disposal by merely choosing pulling the pumping handle or pedalling the foot pedal according to circumstances, so that this versatility can alleviate operators' fatigue and increase their working efficiency.

Accordingly, it is an object of this invention to provide a truck with a hand-operatable bed by which operators can be told about the weight of cargoes in the middle of their handling and previously avoid the danger of their collapsing due to the imbalance of their weight. It is another object of this invention to provide a truck with a hand-operatable bed which can be elevated slowly for fast at operators' disposal or according to circumstances.

The above and other objects and features of this invention will appear more fully hereinafter from the consideration of the following description taken in connection with the accompanying drawing wherein examples are illustrated by way of example. In the drawing.

PREFERRED EMBODIMENT OF THIS INVENTION

In order that this invention may be understood more clearly, reference will now be made to a preferred embodiment of this invention.

Figure 2:
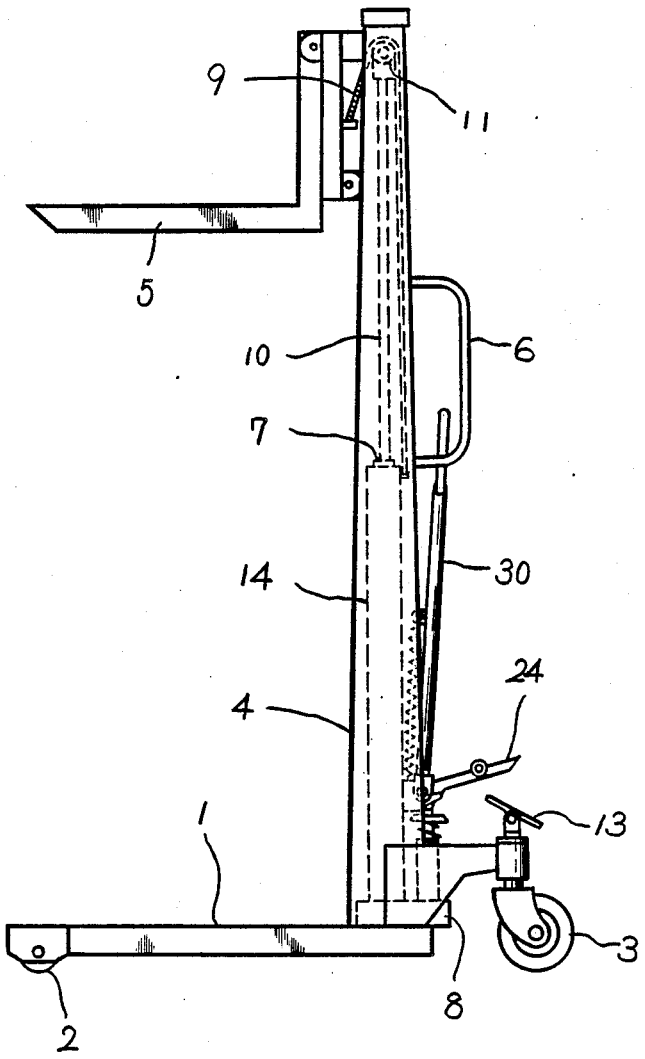
FIG. 2 is a side view of the truck of this invention.
Figure 3:
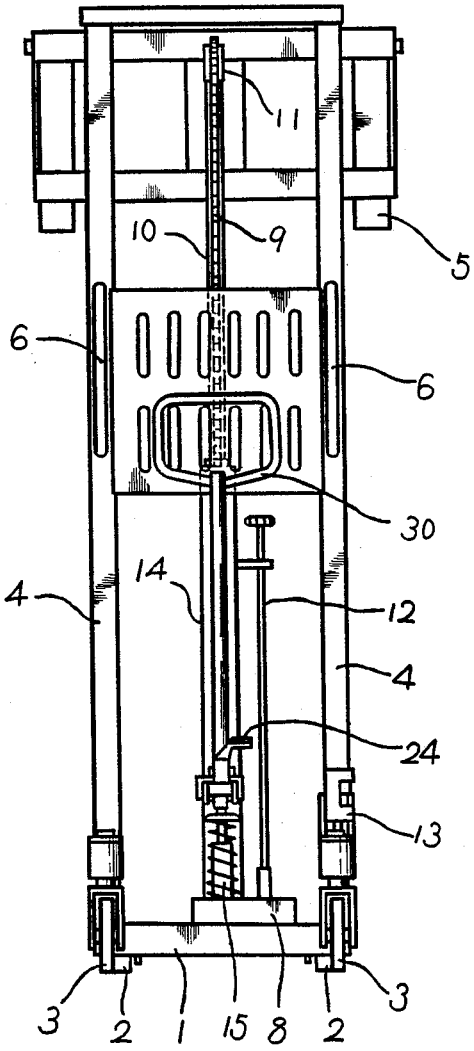
FIG. 3 is a rear view of the same truck as the one shown in FIG. 2.

In FIGS. 2 and 3, a chassis 1 is provided with a pair of front wheels 2, 2, and a pair of rear wheels 3, 3. A pair of vertically juxtaposed masts 4, 4 are provided to the rear portion of the truck, parallel to each other. A bed 5, for example a forked bed, on which cargoes are placed, is held between the paired parallel masts 4, 4 in such a way as to move upward and downward freely. A pair of handles 6, 6, which operators hold when moving the truck, are provided to the rear side of the masts 4, 4, nearly in the middle thereof.

Figure 5:
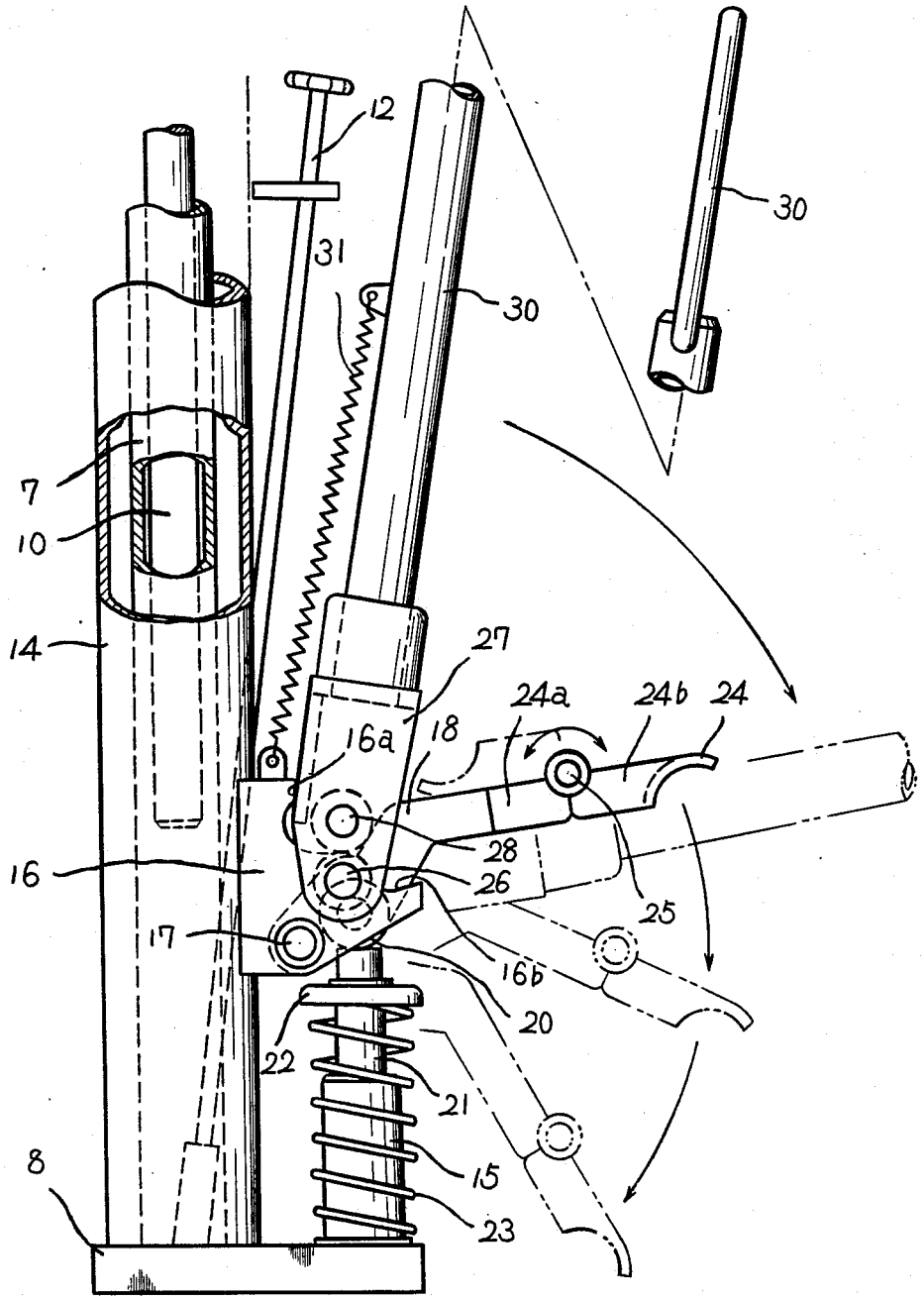
FIG. 5 is a side view of the same portion as that shown in FIG. 4.

A cylinder 7 for upwardly or downwardly moving the bed 5 between the masts 4, 4 with its hydraulic pressure stands on a hydraulic pressure switching circuit base 8. A length of load chain 9 connects the bed 5 to the cylinder 7 with a toothed wheel 11 held by a piston rod 10 of the cylinder 7, as shown in FIG. 5. The numeral 12 denotes a lever for removing hydraulic pressure inside the cylinder 7 by taking out oil therefrom so that the bed 5 lowers. A brake pedal 13 is provided to one of the masts 4, 4, and used to brake the rear wheels 3, 3 when the truck is required to turn.

Figure 8:
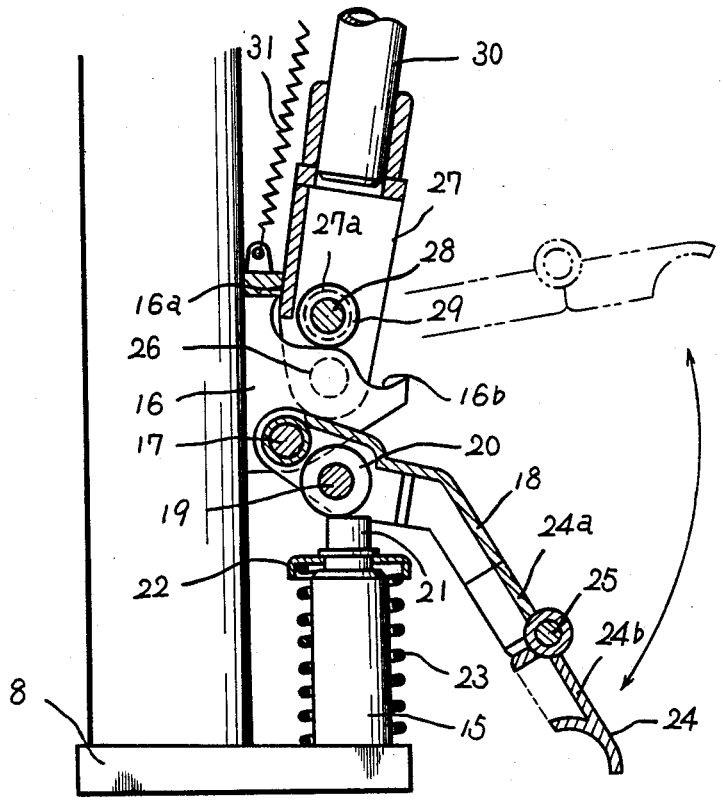
Figure 9:
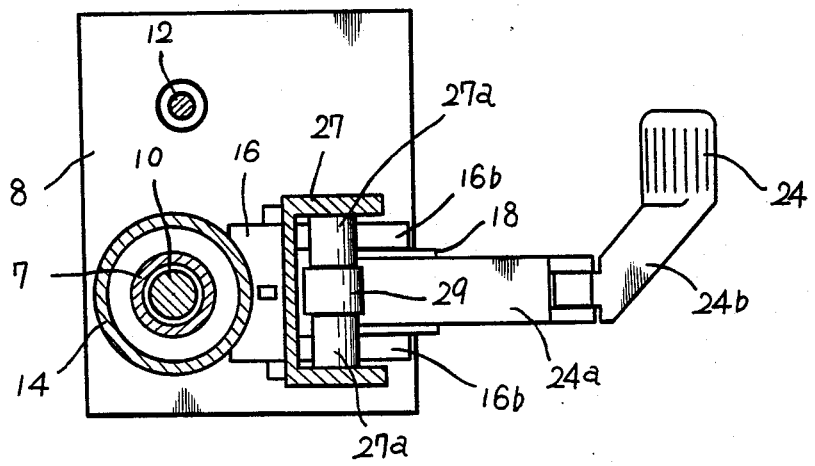
FIG. 9 is a plan view of the same portion as that shown in FIG. 4.

An oil tank 14 shown in FIGS. 4 through 9 serves to hold oil for hydraulically moving the cylinder 7, which is disposed in the surroundings of the cylinder 7 in such a circular manner as to enclose it, as shown in FIG. 9. A plunger pump 15 for feeding oil into the cylinder 7 stands on the hydraulic pressure switching circuit base 8 in the upright position. Provided to the outside of the oil tank 14 is a bracket 16 to fix pivots 17, 17 with to which an inverted U-shape arm 18 is pivotally joined. The arm 18 is provided with a pressing roller 20 which is secured to the arm's inside with a shaft 19. A piston rod 21, put in the center of the plunger pump 15, whose top is always brought into contact with the pressing roller 20, is provided a flange 22 to receive the upwardly exerting elastic force of a compressed spring 23.

A foot pedal 24, comprised of two articulate arms 24*a*, 24*b*, is connected to the above-mentioned arm 18, wherein only the fore-articulate arm 24*b* is devised in such a way as to fall on the hind one 24*a* and the arm 18 face to face by means of a hinge 25; thus, the articulate pedal 24 is useful for operators to keep the truck for a while in a narrow place. Needless to say, the articulate pedal 24 is extended when its pedalling is required to pump oil into the plunger pump 15.

Figure 4:
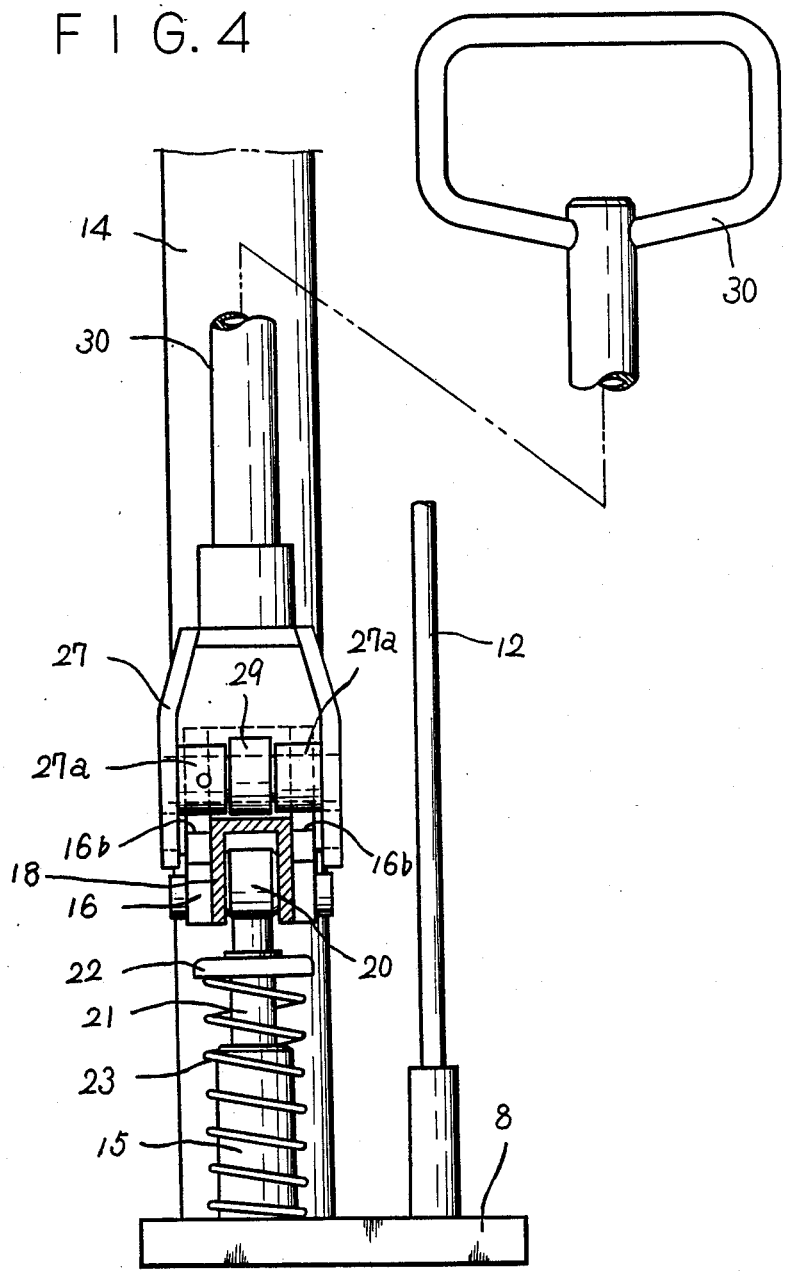
FIG. 4 is a rear view of an essential portion of the same truck as the one shown in FIG. 1.

As shown in FIGS. 4 and 5, the lower end of a pumping handle receiver 27, which is machined into an inverted U-shape so that part of the arm 18 is held in it, is supported by a pair of pivotal joint 26, 26. The inside of the lower end of the pumping handle receiver 27, holding part of the arm 18, inwardly projects in such a way as to form a pair of opposing thick portions 27*a*, 27*a*, in the center hole of which a shaft 28 to bear a pressing roller 29 with is put. The under surface of the pressing roller 29 is brought into contact with the upper surface of the arm 18. The base of a pumping handle 30 is received by the receiver 27.

Figure 6:
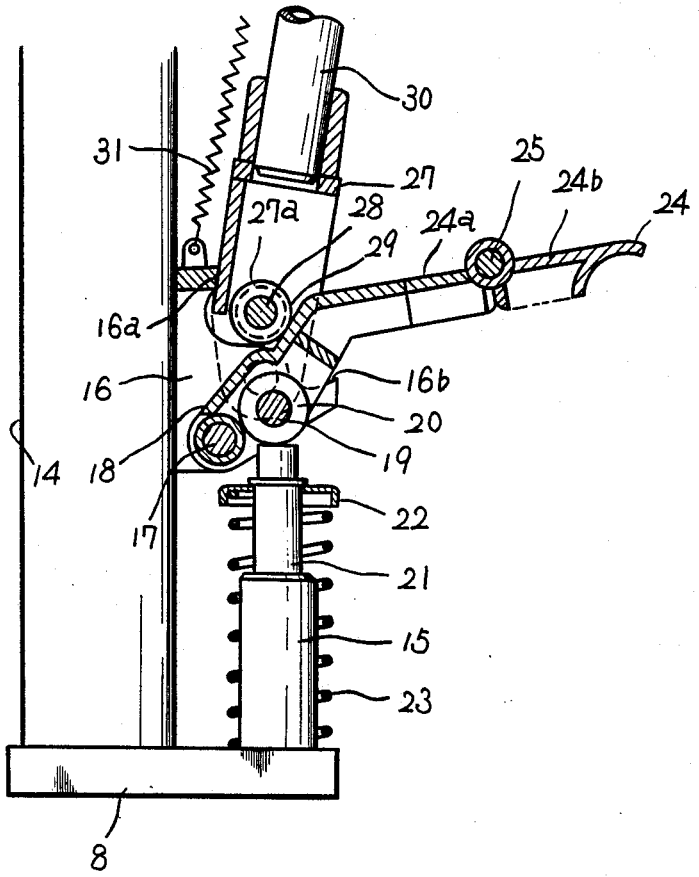
FIGS. 6 through 8 are a partially cross-sectioned side view of the same portion as that shown in FIG. 4, which are to show the pumping action of a foot pedal stepwise.
Figure 7:
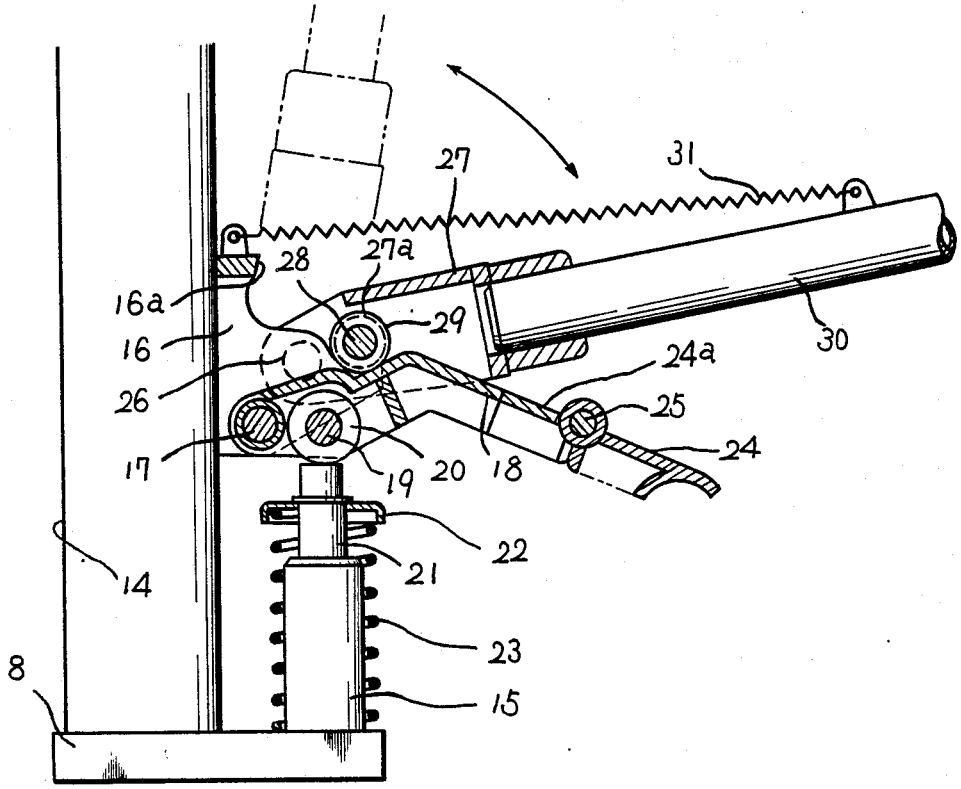

The structure of the joint portion is such that the foot pedal 24 can be swivelled around the pivot 17 either by pedalling it alone or by pulling the pumping handle 30, which swivels around the pivots 26, 26. Moreover, as shown in FIGS. 5 and 6, the pivots 26, 26 are located in such a position, relative to the shaft 28 of the pressing roller 29 and the pivot 17, that the swivelling displacement of the pressing roller's center around the pivot 26 is greater than that of the pressing roller's contact point with the arm 18 around the pivot 17. In other words, the rotational movement of the foot pedal 24 is devised to be smaller and slower than that of the pumping handle 30 by the location of the pivots 26, 26. Thereby, the bed 5 can be elevated at a slower rate a little pitch by a little pitch by the cylinder 7 each time the pumping handle 30 is pulled to move the foot pedal than each time the foot pedal alone is pedalled to pump oil into the cylinder.

Meanwhile, the swivelling of the pumping handle 30 is restricted within an angle of about 70° by a pair of stoppers 16*a*, 16*b* provided to the bracket 16, wherein the angle is settled from such a practical point of view to facilitate the swivelling motion of the pumping handle 30 most. In this connection, a spring 31 spans the bracket 16 and the middle of the pumping handle 30 in order that the pumping handle 30 may keep almost an upright position.

Figure 1:
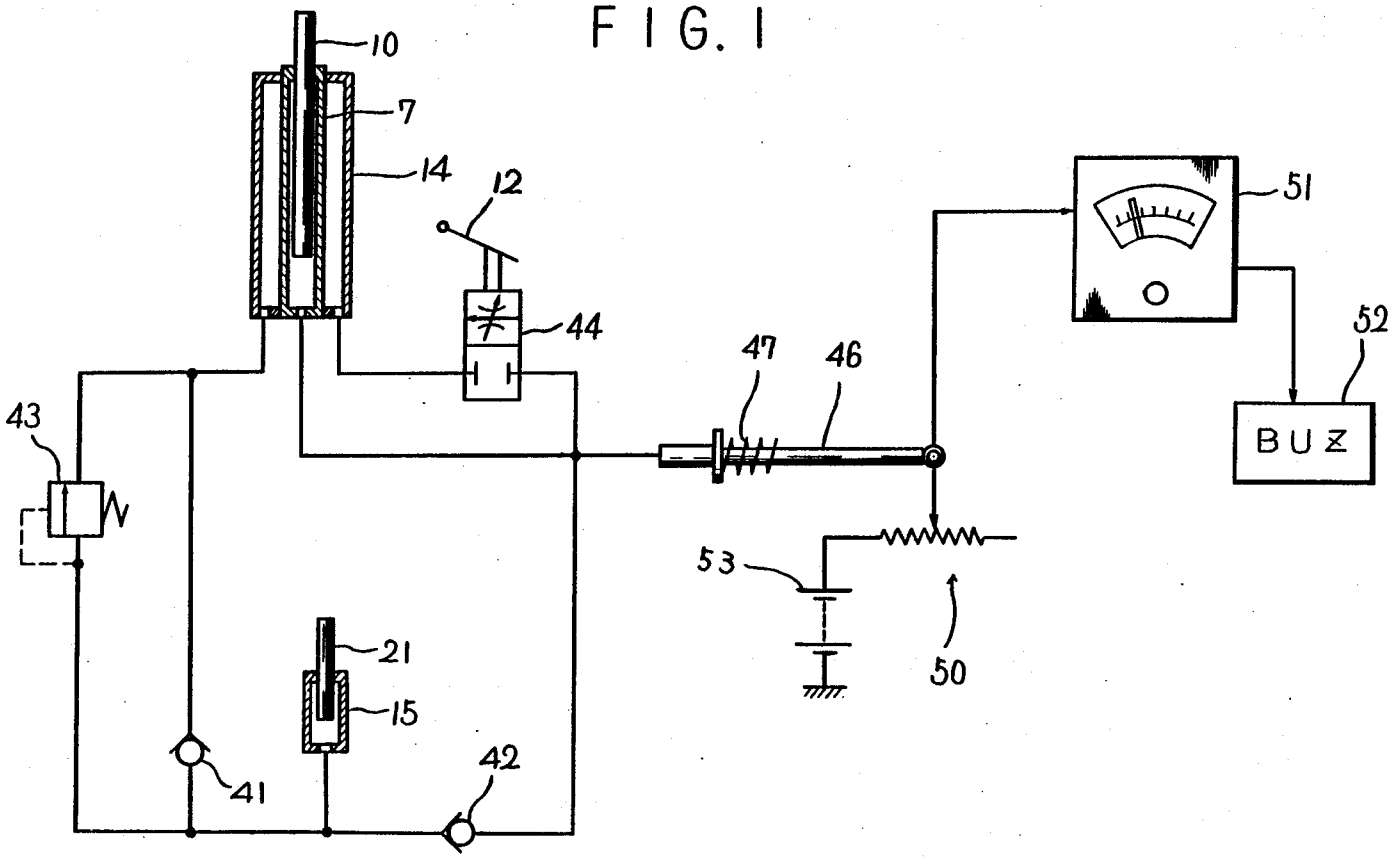
FIG. 1 is an illustration schematically showing an operation system of the truck of this invention.
Figure 10:
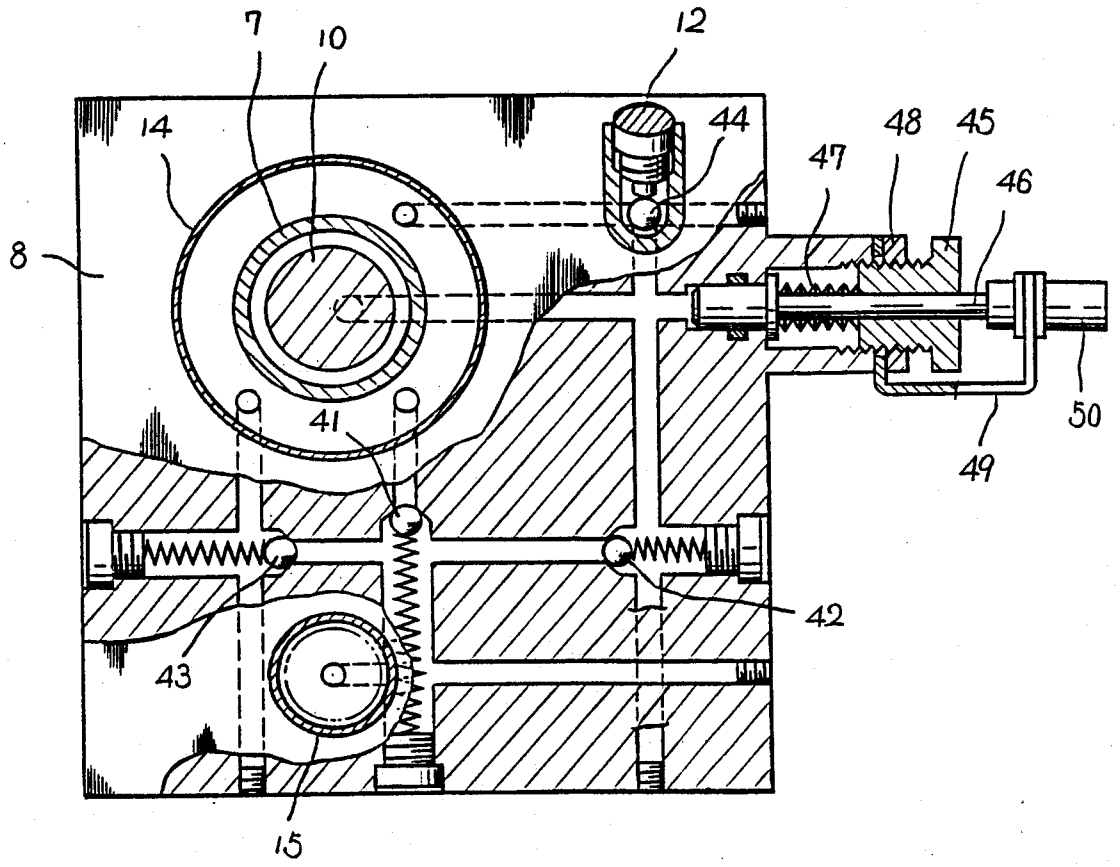
FIG. 10 is an illustration showing a hydraulic pressure switching circuit.

As shown in FIGS. 1 and 10, the plunger pump 15 communicates with the oil tank 14, putting an oil inlet checking valve 41 therebetween. Moreover, the plunger pump 15 communicates with the cylinder 7, putting an oil outlet checking valve 42 therebetween. Furthermore, a releasing valve 43 is provided to the middle of the plunger pump 15 and the oil tank 14 in order to release pressured oil over a limit so that the cylinder can be raised by a limited hydraulic pressure. Also, the cylinder communicates with the oil tank 14, putting a pressure-removing valve 44 therebetween, which can be opened or closed by the afore-mentioned lever 12 in order to control the descending movement of the cylinder 7.

A pressure-adjusting screw 45 is inserted in the hydraulic pressure switching circuit base 8 with thread. A pressing rod 46 is put in the pressure-adjusting screw 45 in such a slidable way that, when the inner end thereof is pushed outward against the inwardly directed elastic force of a belleville spring 47 by increased hydraulic pressure inside the cylinder 7, the outer end thereof comes out in accordance therewith. A U-shape leaf spring 49 is fixed to the hydraulic pressure switching circuit base 8 with a lock nut 48 with which the pressure-adjusting screw 45 is secured to the same base 8. A potentiometer 50 for detecting the change in the cylinder's inside pressure and getting a load indicator 51 display the weight of a load on the bed 5 and a buzzer 52 sound for alarming when the load is overweight is provided to the other end of the leaf spring 49 in such a way as to receive a push of the pressing rod 46. In relation to this electric mechanism, a battery 53 is mounted on the foot of either of the masts 4, 4.

One embodiment of this invention is constructed such that when the bed 5 with a cargo is lifted up by means of the cylinder 7 with its inside hydraulic pressure being increased by strokes of the pumping handle 30, the pressing rod 46 comes out of the base 8, overcoming the inwardly directed elastic force of the belleville spring 47 and acts on the potentiometer 50 so as to sense the increase in the cylinder's inside pressure and allow the indicator 51 to indicate the weight of the cargo on the bed 5. The potentiometer 50 also actuates the buzzer 52 to sounding if the cargo is overweight.

In the case that operators desire to elevate a comparatively heavy cargo by means of the bed 5, they can lift it up at a comparatively slow rate a little pitch by a little pitch by pulling the pumping handle 30; at this moment, the pumping handle receiver 27 and the arm 18 work in one, putting the pressing roller 29 between them, in such a way as to press down the second pressing roller 20 so as to force in the piston rod 21 of the plunger pump 15, supported by the spring 23 and permit it to feed oil from the oil tank 14 into the cylinder 7, as shown in FIG. 6. Also, in the case that operators desire to elevate a comparatively light cargo by means of the bed 5 or elevate the empty bed 5 alone in order to take a cargo from a height, they can lift it up at a comparatively rapid rate by greater pitch by pedalling the foot pedal 24; at this moment, only the arm 18 is operated with the pumping handle 30 kept standing upright by the spring 31 as shown in FIG. 8, so as to press down the second pressing roller 20 and feed oil from the oil tank 14 into the cylinder 7 by the use of the piston rod 21 of the plunger pump 15 in the same way as the above.

Figure 11:
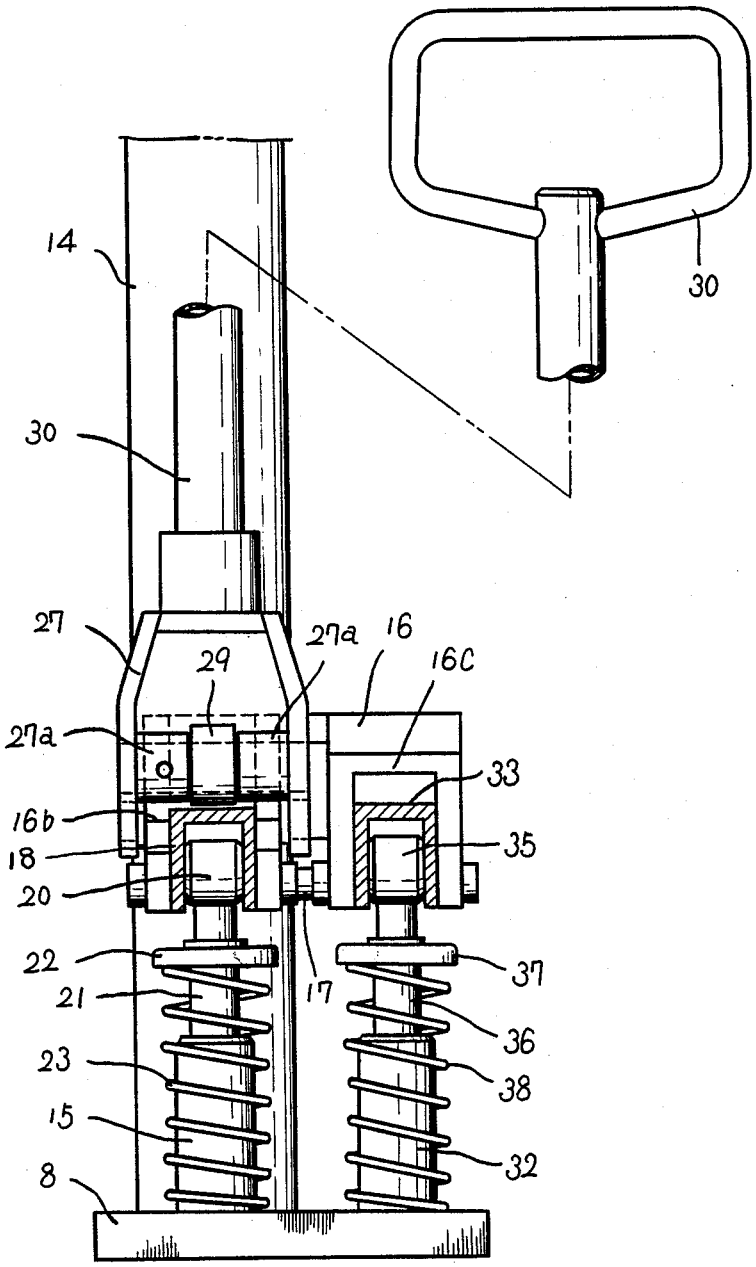
FIG. 11 is a rear view of an essential portion of another truck of this invention.
Figure 12:
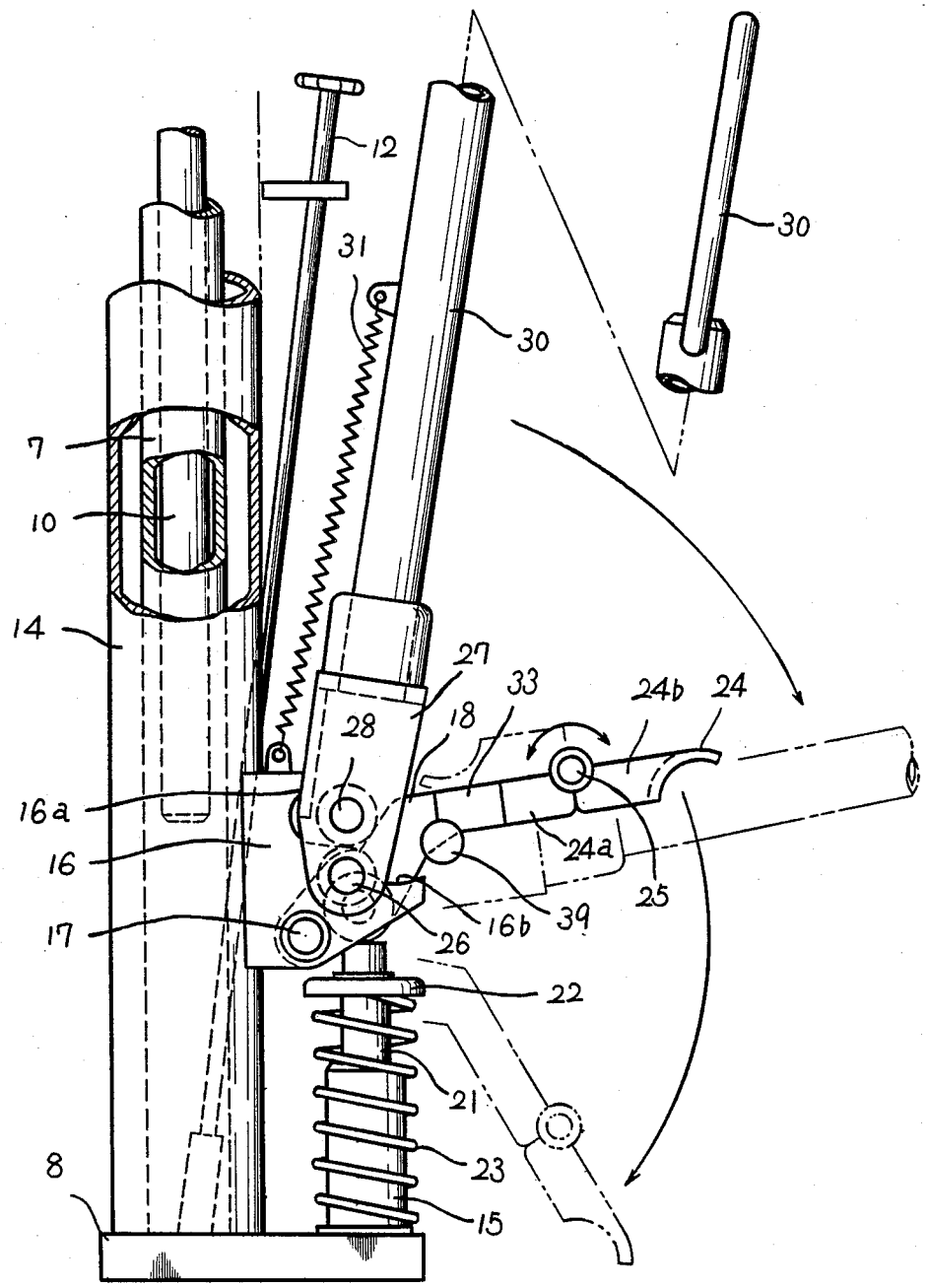
FIG. 12 is a side view of the same portion as that shown in FIG. 11.
Figure 13:
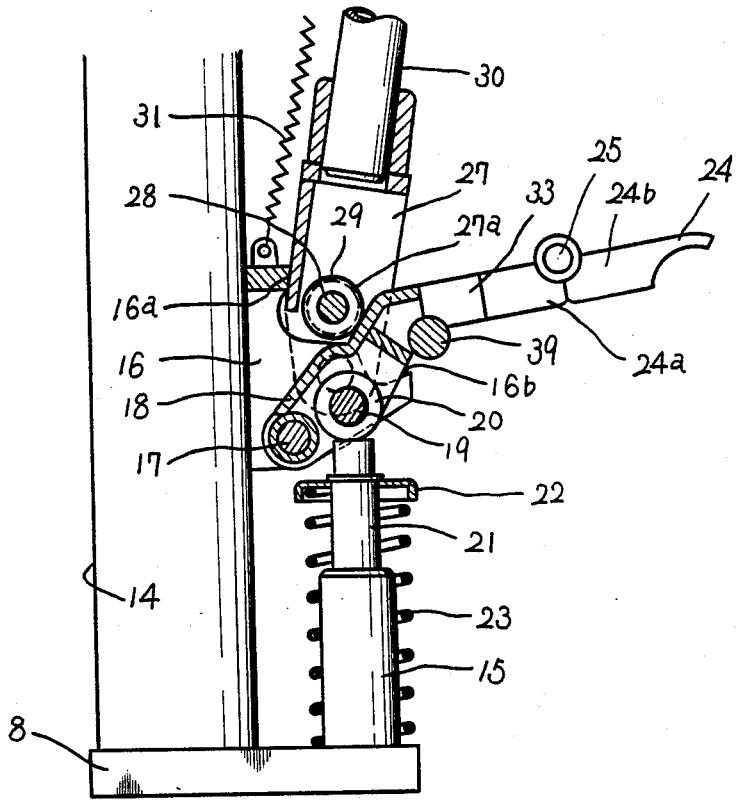
FIGS. 13 through 15 are a partially cross-sectioned side view of the same portion as that shown in FIG. 11.

Another truck of this invention is shown in FIGS. 11 through 16. In this embodiment, a sub-plunger pump 32 is installed on the hydraulic pressure switching circuit base 8 side by side with the plunger pump 15, as shown in FIG. 11. Correspondent to the sub-plunger pump 32, another arm 33 of the foot pedal 24 is held by the pivot 17 fixed to the bracket 16 on the outside of the oil tank 14. Another pressing roller 35, corresponding to the pressing roller 20, is supported by a shaft 34 inside the arm 33. A flange for receiving an upwardly directed elastic force of a spring 38 is provided near the upper end of a piston rod 36 of the plunger pump 32 so that the top of the piston rod 36 is always brought into contact with the pressing roller 35.

The pumping handle receiver 27, which is formed into an inverted U-shape so as to enclose an inverted U-shape arm base 33, is supported by the pivots 26, 26 in the same way as in the former example. The upper surface of the arm 18 is brought into contact with the pressing roller 29. The base of the pumping handle 30 is received by the pumping handle receiver 27. A pair of stoppers 16*a*, 16*b* to define the upright and the fallen positions of the pumping handle 30 are provided to the bracket 16. Between the bracket 16 and almost the middle of the pumping handle 30 spans the spring 31 to keep the pumping handle upright with. Like this, the left half of the structure in FIG. 11 is so similar to that in the former example that strokes of the pumping handle 30 can cause strokes of the plunger pump 15.

Figure 14:
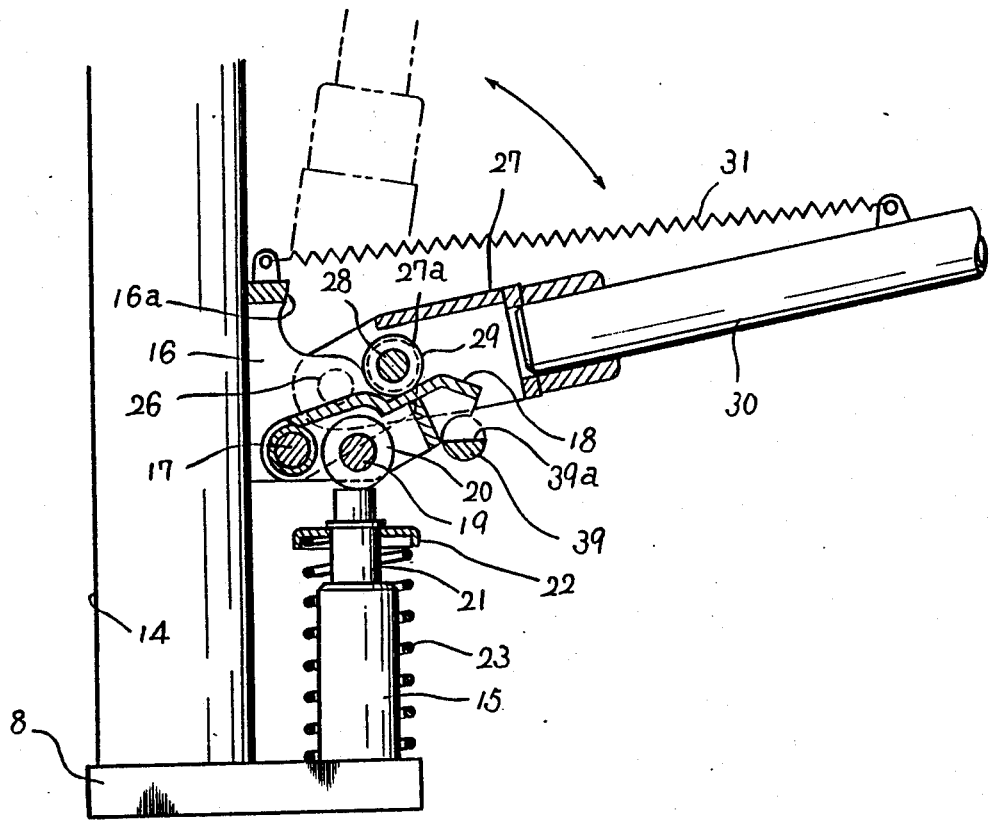
Figure 15:
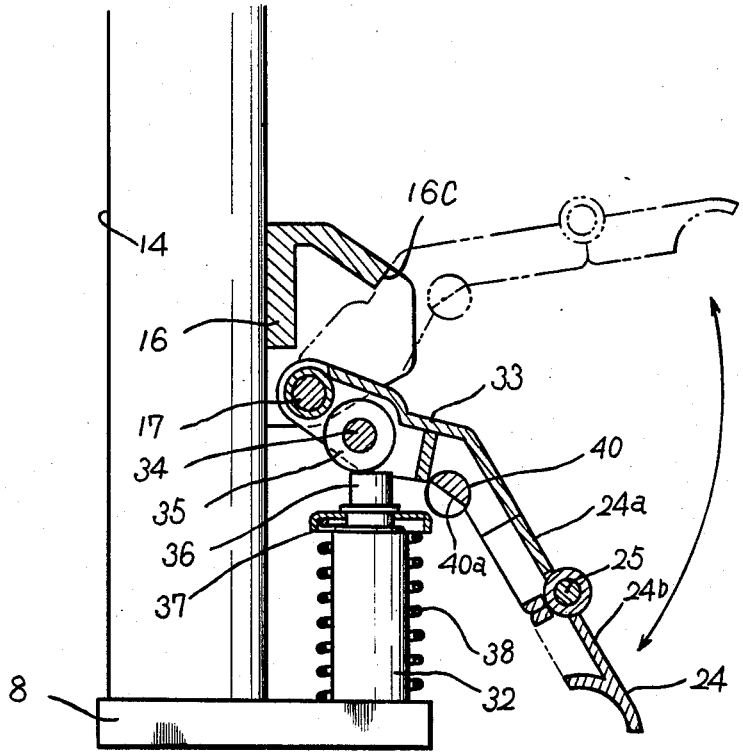
Figure 16:
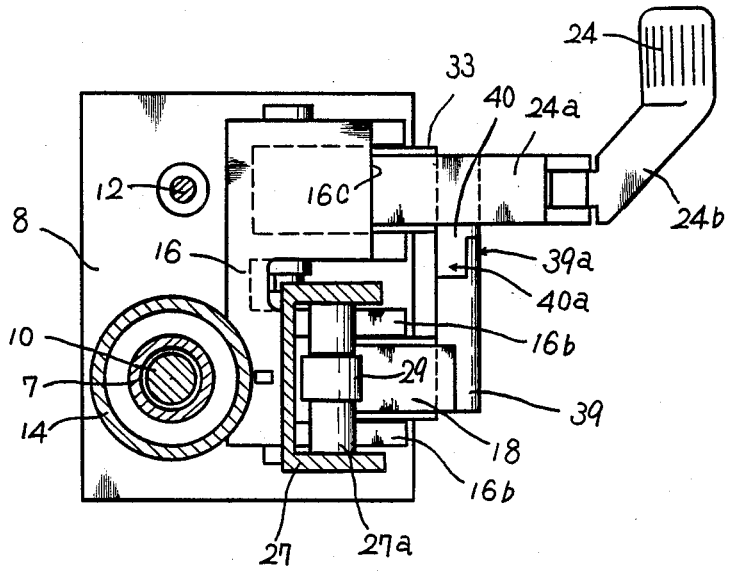
FIG. 16 is a plan view of the same portion as that shown in FIG. 11.

Each of the arms 18, 33 is provided with a horizontal semi-circular cross-sectioned rod 39, 40 respectively so that the center of the two rods falls on the same line as shown in FIGS. 14, 15, and 16. That is, the upper half of the rod 39 and the lower half of the rod 40 are shaved away respectively so as to give a flat plane 39*a*, 40*a* to meet with each other. The foot pedal 24, comprised of the articulated arms 24*a*, 24*b*, is connected to the arm 33 only. A stopper 16*c* to define the upright position of the foot pedal 24 with is fixed to the bracket 16. Thus, the arm 18 can be swivelled, separately from the arm 33 or together with the arm 33, by pedalling the foot pedal 24 connected thereto.

The arms 18, 33 swivel around the pivot 17, while the pumping handle receiver 27 swivels around the pivot 26; moreover, the pivot 26 is located in such a position, relative to the shaft 26 of the pressing roller 29 and the pivot 17, that the swivelling displacement of the pressing roller's center around the pivot 26 is greater than that of the pressing roller's contact point with the arm 18 around the pivot 17, in a similar manner to that in the former example. Thus, the rotational movement of the foot pedal 24, when it is caused by pulling the pumping handle 30, is devised to be smaller and slower than that of the pumping handle 30 by the location of the pivot 26. Thereby, as shown in FIG. 14, the bed 5 can be lifted at a slow rate a little pitch by a little pitch by the cylinder 7 each time the pumping handle 30 is pulled. On the contrary, as shown in FIG. 15, the bed 5 can be lifted much faster, almost twice the speed of the former example, by a greater pitch when the foot pedal 24, connected to the arm 33, is pedalled so as to work both the plunger pumps 15, 32 by the coupling of the arms 18, 33 with the halved rods 39, 40.

In the above examples, it is possible to omit the stopper 16*b* to define the fallen position of the pumping handle 30, because even though the stopper 16*b* is omitted, and thereby the pumping handle 30 is pulled over 70°, there still persists the difference in the elevation speed of the bed between by the employment of the pumping handle 30 and by the employment of the foot pedal 24.

As seen from the above description, a truck of this invention is additionally provided with a load sensor 50 that detects the change in the hydraulic pressure inside the cylinder 7, and an indicator 51 that indicates that change calculated in terms of the weight of a cargo on the bed 5, so that a cargo is lifted up to a height for being kept in a warehouse or for being loaded on an automobile truck with its weight being confirmed with no use of a special balance. Thus, not only is the collapsing of piled cargoes due to the imbalance of their weight in piling prevented previously but also operators can promptly handle them, knowing what cargoes are overweight for loading, which leads to the increase of the practical value of this kind of truck, as well as the improvement in operators' safety.

Moreover, in the truck of this invention, the arm 18 whose top is provided with the foot pedal 24, and the pumping handle receiver 27 which receives the pumping handle, both the foot pedal and the pumping handle being used to pump oil into the cylinder 7 from the oil tank 14, are separately supported by their own pivot 17, 26, and the pivot 26 of the pumping handle receiver 27 is located in such a position, relative to the pivot 17 of the arm 18, and relative to the shaft 28 of the pressing roller 29 that presses down the arm 18 in company with the pulling-down of the pumping handle, as to differentiate the ascending pitch of the bed 5 by one stroke of the pumping handle 30 from that by one stroke of the foot pedal 24.

Thus, when the bed 5 loaded with a comparatively heavy cargo is lifted up, it can be moved up to a height at a slower rate a little pitch by a little pitch by the use of the pumping handle 30, coupled with the foot pedal 24. Also, when the empty bed 5 is lifted up to take a cargo from a height, for example, it can be moved much faster than the above by the sole use of the foot pedal 24. Like this, the bed 5 can be elevated slowly or fast at operators' disposal by merely choosing pulling the pumping handle 30 or pedalling the foot pedal 24 according to circumstances, so that this versatility can alleviate operator's fatigue and increase their working efficiency. Because the pumping handle 30 is kept standing upright with the spring 31 without using complicated structures, such as cam mechanism or lever-switching mechanism, operators can pedal the foot pedal 24 very simply and smoothly, only applying their weight thereon, even in a narrow space.

1. chassis
2. front wheels
3. rear wheels
4. masts
5. bed
6. handles
7. cylinder (hydraulic)
8. hydraulic pressure switching circuit base
9. load chain
10. piston rod
11. toothed wheel
12. lever
13. brake pedal
14. oil tank
15. plunger pump
16. bracket
16*a*. stoppers
16*b*. stoppers
17. pivot(s)
18. inverted U-shape arm
19. shaft
20. pressing roller
21. piston rod
22. flange
23. spring
24. foot pedal
24*a*. articulate arms
24*b*. articulate arms
25. hinge
26. pivot(s)
27. pumping handle receiver
27*a*. thick portion(s)
28. shaft
29. pressing roller
30. pumping handle
31. spring
32. sub-plunger
33. arm
34. shaft

35. pressing roller
36. piston rod
37. flange
38. spring
39. halved rod (39*a* flat plane)
40. halved rod (40*a* flat plane)
41. oil inlet checking valve
42. oil outlet checking valve
43. releasing valve
44. pressure-removing valve
45. pressure-removing screw
46. pressing rod
47. belleville spring
48. locking nut
49. U-shape leaf spring
50. potentiometer
51. indicator
52. buzzer
53. battery What the present inventor claims is:

1. A truck with a hand-operable hydraulic lift bed supported by a chassis provided with wheels for moving said truck, comprising:

a hydraulic cylinder for lifting or lowering said bed on said chassis;

an oil reservoir;

a plunger pump for feeding oil from said reservoir into said hydraulic cylinder;

a pumping handle for operating the plunger of said plunger pump;

a load sensor for detecting changes in the hydraulic pressure inside said hydraulic cylinder;

overload prevention means including a one-way check valve for permitting oil to be drawn from but not returned to said reservoir by said plunger pump and a spring biased safety valve responsive to the pressure created by said plunger pump for returning oil from said plunger pump to said reservoir when the pressure created by said plunger exceeds a limit set by said spring;

a one-way check valve for coupling said plunger pump to said hydraulic cylinder and isolating said safety valve from said hydraulic cylinder; and means for indicating said changes detected by said load sensor in terms of the weight of said load.

2. A truck as defined in claim 1, comprising:

an arm connecting said pumping handle to said plunger;

said arm including a top provided with a foot pedal;

said arm including an arm pivot about which said arm rotates for operating said plunger in response to force applied by said pumping handle or said foot pedal;

a handle pivot supporting said pumping handle; and said handle pivot positioned relative to said arm pivot for limiting the operation of said plunger in response to one stroke of said pumping handle to be less than the operation of said plunger in response to one stroke of said foot pedal.

* * * * *